United States Patent [19]

Amici et al.

[11] Patent Number: 4,561,854

[45] Date of Patent: Dec. 31, 1985

[54] CREATURE WITH SNAP ACTION JAW

[75] Inventors: Francis R. Amici, Northford; Pietro Piazza, Prospect, both of Conn.

[73] Assignee: Coleco Industries, Inc., West Hartford, Conn.

[21] Appl. No.: 703,313

[22] Filed: Feb. 20, 1985

[51] Int. Cl.[4] ..... A63H 3/24; A63H 3/20

[52] U.S. Cl. ..... 446/304; 446/340

[58] Field of Search ..... 446/329, 304, 337, 338, 446/339, 340, 330, 368, 395, 301, 300, 298, 297, 268

[56] References Cited

U.S. PATENT DOCUMENTS

| | | | |
|---|---|---|---|
| 928,744 | 7/1909 | Fisher . | |
| 1,751,773 | 3/1930 | Trosper | 446/304 |
| 1,773,834 | 8/1930 | Wilson . | |
| 1,782,477 | 11/1930 | Price . | |
| 2,158,860 | 5/1939 | Hyde . | |
| 2,241,576 | 5/1941 | Barton . | |
| 2,564,942 | 8/1951 | Wemmer, Sr. | 446/301 X |
| 2,586,081 | 2/1952 | Philippi | 446/304 |
| 2,725,670 | 12/1955 | Hodes . | |
| 3,153,871 | 10/1964 | Semba . | |
| 3,271,898 | 8/1966 | Glass et al. | 446/301 |
| 3,698,127 | 10/1972 | Harp . | |
| 3,699,713 | 10/1972 | Sapkus et al. . | |
| 3,828,469 | 8/1974 | Giroud . | |
| 4,207,704 | 6/1980 | Akiyama . | |
| 4,244,138 | 1/1981 | Holahan et al. . | |
| 4,324,065 | 4/1982 | Cooper . | |
| 4,514,883 | 5/1985 | Barbieri et al. | 446/301 X |

FOREIGN PATENT DOCUMENTS

| | | | |
|---|---|---|---|
| 513907 | 2/1921 | France | 446/340 |
| 507134 | 6/1939 | United Kingdom | 446/304 |

*Primary Examiner*—Mickey Yu

[57] ABSTRACT

A creature with snapping jaws is comprised of a pair of body members defining a body cavity. The lower body member defines a lower jaw portion, an upper jaw member which has a lever arm extending into the cavity at one end, and disposed thereover is wherein it is pivotally mounted for pivotal motion relative to the lower jaw. Also pivotally mounted in the body cavity is an actuator with a button portion projecting through an aperture in the top of the body member and a cam portion which is engageable with the lever arm to produce pivotal movement thereof to open the upper jaw. Biasing means normally biases the upper jaw member into its closed position over the lower jaw portion and the button portion into an elevated position. When the button portion is depressed by finger action, the upper jaw member is opened by the cam action and at a point of maximum opening, the upper jaw member moves clear of its cam surface and snaps shut. Release of pressure on the button portion allows the actuator to return to its position.

20 Claims, 6 Drawing Figures

CREATURE WITH SNAP ACTION JAW

BACKGROUND OF THE INVENTION

Simulated creature toys have long been known and have been provided with various types of simulated action to enhance the play characteristics. Among the types of action that have been incorporated in such toys have been the provision of jaws and beaks which will open and close either as the result of motor action or as the result of some form of manipulation of a portion of the simulated creature.

It is an object of the present invention to provide a novel simulated creature having snapping jaws which may be readily fabricated from relatively few parts and which will provide highly effective snapping simulated jaw action.

It is also an object to provide such a creature in which the several components may be readily assembled to provide a durable structure.

Another object is to provide such a creature in which the component elements defining the exterior appearance of the creature may be altered by changing the molds used for the fabrication thereof to provide a high degree of design versatility.

SUMMARY OF THE INVENTION

It has now been found that the foregoing and related objects may be readily obtained in a simulated creature providing snapping jaws which includes a first body member providing an elongated lower body portion and a lower head and jaw portion of the creature. This first body member defines an upwardly opening cavity therewithin, and a second body member providing an elongated upper body portion of the creature defines a downwardly open cavity therewithin and has an aperture in its upper surface communicating with the cavity and an aperture in its forward end. The first and second body members abut and are engaged along transversely extending surfaces to provide a body assembly.

An upper jaw member disposed on the lower jaw has a lever arm extending rearwardly into the cavity defined between the body members. This lever arm is pivotally mounted to the body assembly by pivot means for pivotal motion of the upper jaw member relative to the lower jaw. Actuator means for effecting pivotal movement of the upper jaw member is provided and includes a manually depressible button portion extending outwardly of the body assembly through the aperture in the upper surface of the upper body member. It also includes a cam portion engageable with the lever arm, and means pivotally mounting it in the body assembly for movement between an at rest position where the button portion projects outwardly of the body assembly and a pivoted position wherein the cam portion is pivoted downwardly.

The cam portion is pivotable downwardly upon depression of the button portion to rush the rearward end of the lever arm downwardly and effect pivotal movement of the upper jaw member from an at rest position abutting the lower jaw to an open position wherein the outer end of the upper jaw member is spaced from the lower jaw. Biasing means biases the upper jaw member into the at rest position adjacent the lower jaw and also biases the actuator means and thereby the button portion into the elevated at rest position. The pivot means, biasing means and cam portion cooperate to permit the lever arm to snap back to its at rest position after its movement to the open position, and the actuator means to pivot back to its at rest position.

In the preferred embodiment of the invention, there is included a multiplicity of legs along each side of the body assembly, and the legs are integrally formed with the first body member. The first body member has a neck portion between the lower body portion and the lower jaw and the second body member provides a cooperating neck portion at one end thereof about the forward aperture thereunto. The pivot means is a pivot pin seated in the neck portion of the second body member. Apertures are provided in the neck portion of the second body member to seat the pivot pin, and there is included a collar extending about the neck portions and concealing these apertures and locking the pivot pin therein.

In the most desirable form of the structure, the lever arm has an elongated slot through which the pivot pin extends to permit movement of the upper jaw member longitudinally of the body assembly as well as pivotally about the pivot pin. The lever arm also has a cam surface along its rearward end along which the cam portion of the actuator means slides to produce the longitudinal movement of the lever arm during return of the actuator means to the at rest position.

Desirably the biasing means is a resiliently expansible member connected between the actuator means and the lever arm. In its preferred form, this is a tension spring secured at one end to the lower end of the lever arm and at its other end to the lower end of the actuating means, and the point of the connection to the actuator means is below the point of connection to the lever arm.

In the most desirable form of the present invention, the actuator means is pivotally mounted adjacent its upper rearward end and the cam portion is at its forward end with the button portion being intermediate the pivotal mounting and the cam portion.

DETAILED DESCRIPTION OF THE ILLUSTRATED EMBODIMENT

Figure 1:
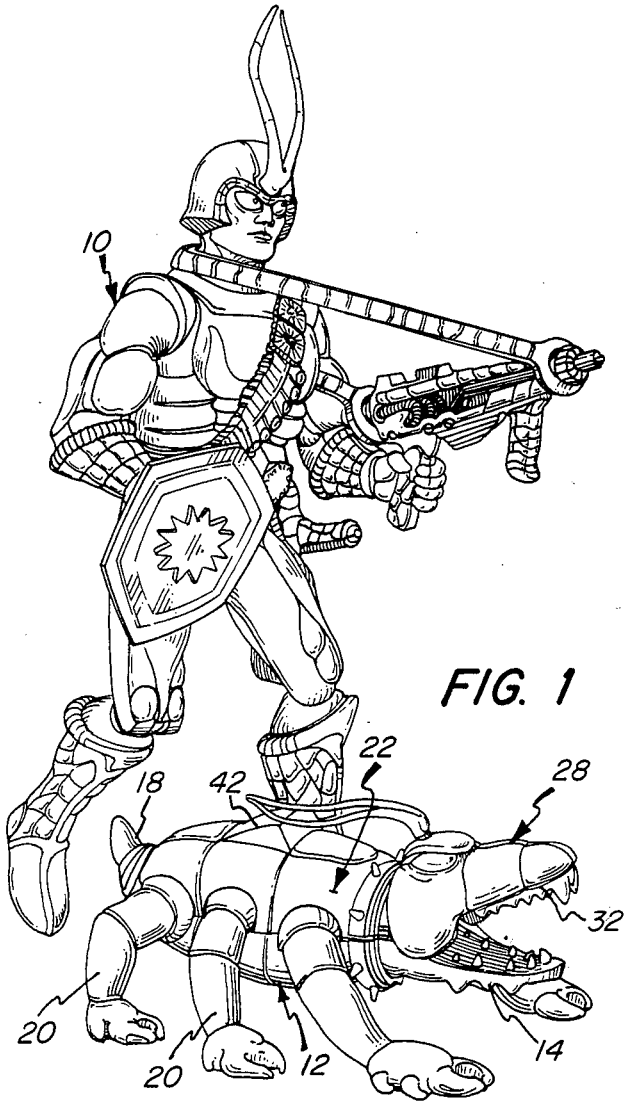
FIG. 1 is a perspective view of a creature with snapping jaws embodying the present invention with the upper jaw member in the pivoted, elevated position, and also showing a humanoid figure with which this creature is associated during play action.

Turning first to FIG. 1 of the attached drawings, therein illustrated is a snapping jaw creature of the present invention in association with a humanoid generally designated by the numeral 10. The creature is comprised of a lower body member generally designated by the numeral 12, an upper body member generally designated by the numeral 22, an upper jaw member generally designated by the numeral 28, and an actuator generally designated by the numeral 42.

Figure 3:
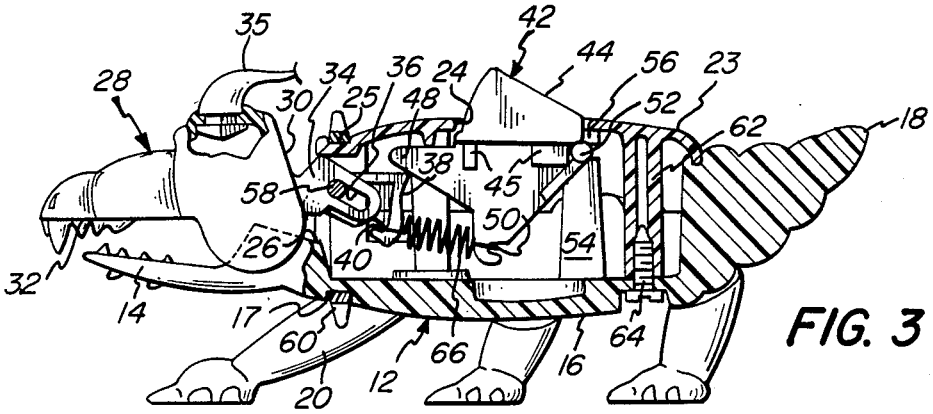
FIG. 3 is a side elevational view thereof with portions broken away to illustrate internal structure and showing the actuating means and jaw member in their initial or at rest positions.
Figure 4:
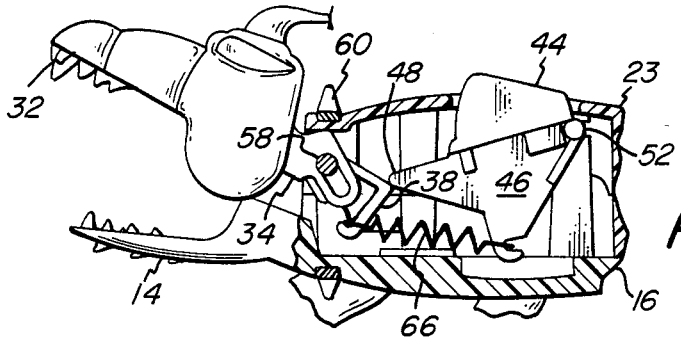
FIG. 4 is a fragmentary side elevational view similar to FIG. 3 showing the actuator means and jaw member during depression of the button with the jaw member at its elevated position.
Figure 5:
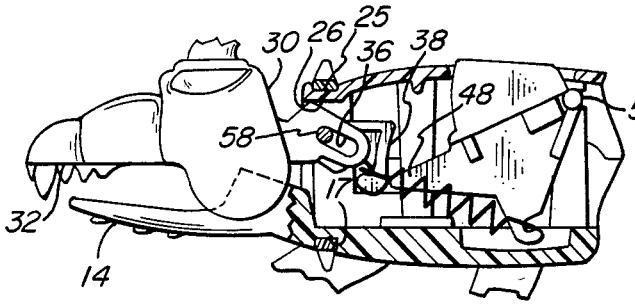
FIG. 5 is similar to FIG. 4 but showing the jaw member after it has moved clear of the actuator means and snapped back to its at rest position.

Turning now to FIGS. 1 and 3, the lower body member 12 is configured to provide a torso 16, a lower head and jaw 14, an intermediate neck portion 17 and a tail 18. Extending outwardly along each side thereof is a multiplicity of legs 20.

The upper body member 22 is configured to provide a torso 23 having an aperture 24 in the top thereof, and a neck 25 surrounding an aperture 26 in the front thereof.

The upper jaw member 28 has a head portion 30, a jaw portion 32, and a lever arm 34 extending rearwardly into the cavity defined between the body members 12, 22. Adjacent its rearward end, the lever arm 34 has a downwardly and rearwardly extending pivot slot 36, and it has a concave arm surface 38 at its rearward end. At its lower rearward end, there is provided a hook 40 for a purpose to be described more fully hereinafter. In addition, the upper jaw member 28 has antennae 35 extending through an aperture therein.

The lever arm 34 of the upper jaw member 28 is pivotally mounted by the elongated pin 58 which has its ends seated in apertures formed in the neck 25 of the upper body member 22. The pivot pin 58 is freely slidable within the elongated pivot slot 36 in the lever arm 34 so that the upper jaw member 28 not only may pivot thereabout but also may move longitudinally inwardly and outwardly of the cavity between the body members 12, 22.

Turning now in detail to the actuator member 42, it has a button element 44 of greater height at its forward end which projects outwardly of the aperture 24 in the top of the body member 22. It also has a cam element 46 which is disposed within the body cavity and which is provided with a nose portion or cam surface 48 at its forward end that is adapted to abut and engage the rearward portion of the lever arm 34 including the cam surface 38 as seen in FIGS. 2–6. The button element 44 has depending legs 45 which extend along the side surfaces of the cam element 46 and which are bonded thereto to secure the elements 44,46 in assembly to form the actuator 42. At its upper rearward end, the cam element 46 is provided with a pivot shaft 52 which is reinforced by webs 53 extending outwardly and upwardly from the sides of the cam element to the projecting portions of the pivot shaft 52. At its lower rearward end, the cam element 46 is provided with a recess 50.

The actuator member 42 is pivotally mounted within the cavity defined by the body members 12, 22 by capturing the pivot shaft 52 between the upstanding posts 54 formed in the lower body member 12 and the bosses 56 formed on the upper body member 22.

As also illustrated, the cam element 46 extends downwardly into the body cavity below the level of the lever arm 34 and a recess 68 is formed in the bottom of the lower body member 12 into which it may pivot.

The spring 66 has one end engaged in the slot 40 formed in the lever arm 34 and its other end engaged in the spring recess 50 of the actuator 42. As a result, it normally biases the upper jaw member 28 into the closed position seen in FIG. 3 and the actuator 42 into the elevated position also seen in FIG. 3.

Figure 2:
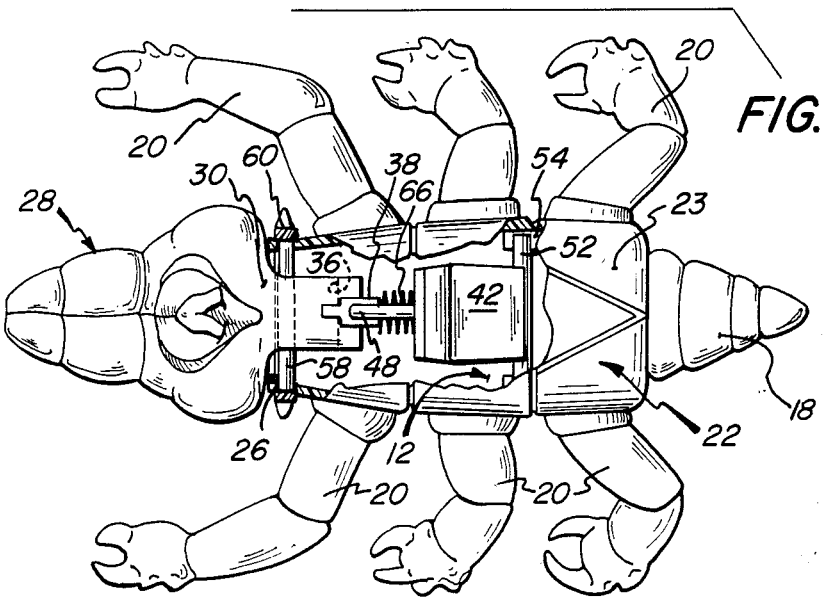
FIG. 2 is a top view of the creature of FIG. 1 drawn to an enlarged scale with portions broken away to illustrate internal structure.

As seen in FIG. 2, to assemble and secure the upper and lower body members 12, 22 a series of depending posts 62 are formed about the upper body member 22 and extend downwardly to the wall of the cavity defined by the lower portion of the lower body member 12, and screws 64 extend upwardly through the lower body member 12 and threadably engage in the posts 62. To conceal and retain the pivot pin 58, a pair of semicircular collar elements 60 are disposed about the neck portions 17, 25 and bonded to the body members 12, 22.

The operation of the snap acting jaws is illustrated in FIGS. 3–6. FIG. 3 illustrates the elements in the at rest position with the jaw portion 32 of the upper jaw member 28 disposed adjacent the lower jaw 14 and with the button element 44 projecting upwardly from the upper body member 28. Upon finger pressure on the forward portion of the button element 44, the actuator 42 pivots about its pivot shaft 52, and its nose portion 48 pushes downwardly on the rearward end of the lever arm 34 causing the upper jaw member 28 to pivot about the pivot pin 58 and thereby open the jaw portion 32 of the upper jaw member 28 to the position seen in FIG. 4.

Figure 6:
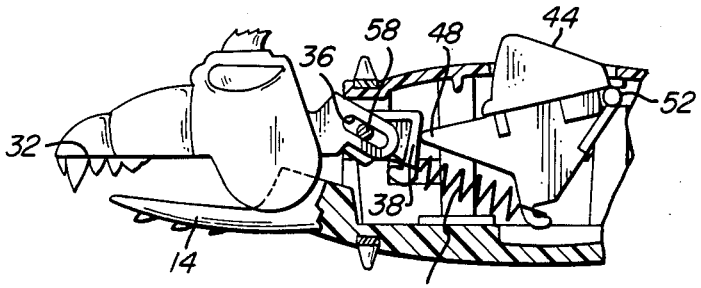
FIG. 6 is a similar view showing the actuator means in the process of returning to its at rest position.

Further downward movement of the nose portion 48 urges the upper jaw member 28 forwardly as the pivot pin 58 slides in the pivot slot 36, thus allowing the nose portion 48 to move beyond the upper rearward end of the cam surface 48. The biasing action of the spring 66 then causes the upper jaw member 28 to rapidly pivot about the pivot pin 58 into the initial at rest position, the elements now assuming the position seen in FIG. 5. Upon release of the finger pressure on the button element 44, the spring 66 biases the actuator 42 so that the nose portion 48 moves upwardly along the cam surface 48, and which produces longitudinal movement of the upper jaw member 28 forwardly relative to the body cavity, and the pin 58 slides in the elongated slot 36 as depicted in FIG. 6. This pivotal movement of the actuator 42 continues until the nose portion 48 moves upwardly of the cam surface 48 and the spring 66 draws the upper jaw member 28 rearwardly into the body cavity and under the forward portion of the nose portion 48, i.e., into the position seen in FIG. 3.

In assembling the creature of the illustrated embodiment, the antennae 35 are inserted through an aperture in the upper jaw member 28. The upper body member 22 is inverted and the actuator 42 is placed in position with the button element 44 extending through the aperture 24 and the pivot shaft 52 seated on the bosses 56. The upper jaw member 28 is then inserted into the aperture 26 and the pivot pin is passed through the aperture on one side of the neck 25, through the slot 36 in the lever arm 34 of the upper jaw member 26, and into the aperture on the other side of the neck 26, thus pivotally mounting the jaw member 28 in the upper body member 28. The spring 66 is then attached to the spring recess 50 of the actuator 42 and to the slot 40 of the lever arm 34 of the upper jaw member 28 so that the elements are biased into the position seen in FIG. 3.

At this point, the lower body member 12 may be assembled to the upper body member 22, and screws 64 are threadably engaged in the posts 62 to secure the body members 12, 22 in assembly. Lastly, the collar elements 60 are bonded to the outer surface of the neck portions 25, 17 to secure the pivot pin 58 in assembly.

It will be appreciated that various of the elements may be adhered by separate adhesive coatings or by interfacial bonding produced by ultrasonic welding or like techniques. It will also be appreciated that tensioning means other than the tension spring of the illustrated embodiment may also be employed such as, for example, rubber bands, or plural compression springs by inverting the action.

Because the several elements are fabricated from synthetic resin using conventional molding techniques, the appearance of the creature may be readily varied. Although the illustrated embodiment is one in which the leg elements are fabricated as a part of the lower body member and seat in cooperating notches in the upper body member, the legs may be separately molded, introduced into the cavity between the body members, and trapped in apertures formed along the abutting surfaces.

Thus it can be seen from the foregoing detailed specification and attached drawings that the snapping jaw creature of the present invention is one which may be readily fabricated from elements which themselves may be fabricated relatively economically from synthetic resins. Moreover, the elements may be readily assembled to provide a relatively long-lived structure. The individual parts may be molded from resins specifically suitable for the applications, and by change in molds, the appearance of the creature may be readily varied.

Having thus described the invention, what is claimed is:

1. A simulated creature having snapping jaws comprising:

A. a first body member providing an elongated lower body portion and a lower head and jaw portion of a creature, said first body member defining an upwardly opening cavity therewithin;

B. a second body member providing an elongated upper body portion of a creature and defining a downwardly opening cavity therewithin, said second body member having an aperture in its upper surface communicating with said cavity, said first and second body members abutting and being engaged along transversely extending surfaces to provide a body assembly;

C. an upper jaw member on said lower jaw and having a lever arm extending rearwardly into the cavity defined between said body members;

D. pivot means pivotably mounting said lever arm to said body assembly for pivotal motion of said upper jaw member relative to said lower jaw;

E. actuator means for effecting pivotal movement of said upper jaw member upon movement thereof including a manually depressible button portion extending outwardly of said body assembly through said aperture and a cam portion engageable with said lever arm, said actuator means being pivotably mounted in said body assembly for movement between an at rest position wherein said button portion projects outwardly of said body assembly and a pivoted position wherein the cam portion is pivoted downwardly, said cam portion pivoting upon depression of said button portion to cam said lever arm and effect pivotal movement of said upper jaw member from an at rest position abutting said lower jaw to an open position wherein the outer end of said upper jaw member is spaced from said lower jaw; and F. biasing means biasing said upper jaw member into the at rest position adjacent said lower jaw and biasing said actuator means and thereby said button portion into an elevated at rest position, said pivot means, biasing means and cam portion cooperating to permit said lever arm to snap back to its at rest position after its movement to the open position and said actuator means to pivot back to its at rest position.

2. The creature in accordance with claim 1 wherein there is included a multiplicity of legs along each side of said body assembly.

3. The creature in accordance with claim 2 wherein said legs are integrally formed with said first body member.

4. The creature in accordance with claim 1 wherein said first body member has a neck portion between said lower body portion and said lower jaw and wherein said second body member provides a cooperating neck portion at one end thereof.

5. The creature in accordance with claim 4 wherein said pivot means is a pivot pin seated in said neck portion of said second body member.

6. The creature in accordance with claim 5 wherein said neck portion of said second body member has apertures therein seating said pin and wherein there is included a collar extending about both of said neck portions and concealing said apertures.

7. The creature in accordance with claim 2 wherein said lever arm has an elongated slot through which said pivot means extends to permit movement of said upper jaw member longitudinally of said body assembly as well as pivotal movement about said pivot means.

8. The creature in accordance with claim 7 wherein said lever arm has a cam surface along its rearward end along which said cam portion of said actuator means slides to produce longitudinal movement of said lever arm during return of said actuator means to the at rest position.

9. The creature in accordance with claim 1 wherein said biasing means is a resiliently expansible member connected between said actuator means and said lever arm.

10. The creature in accordance with claim 9 wherein said expansible member is a tension spring secured at one end to the lower end of said lever arm and at its other end to the lower end of said actuator means, the point of connection to said actuator means being below the point of connection to said lever arm.

11. The creature in accordance with claim 7 wherein said biasing means is a resiliently expansible member connected between said actuator means and said lever arm.

12. The creature in accordance with claim 11 wherein said expansible member is a tension spring secured at one end to the lower end of said lever arm and at its other end to the lower end of said actuator means, the point of connection to said actuator means being below the point of connection to said lever arm.

13. The creature in accordance with claim 1 wherein said actuator means is pivotably mounted adjacent its upper rearward end, said cam portion is at its forward end, and said button portion is intermediate said pivotal mounting and said cam portion.

14. The creature in accordance with claim 13 wherein said lever arm has an elongated slot through which said pivot means extends to permit movement of said upper jaw member longitudinally of said body assembly as well as pivotal movement about said pivot means.

15. The creature in accordance with claim 14 wherein said lever arm has a cam surface along its rearward end along which said cam portion of said actuator means slides to produce longitudinal movement of said lever arm during return of said actuator means to the at rest position.

16. The creature in accordance with claim 15 wherein said biasing means is a resiliently expansible member connected between said actuator means and said lever arm.

17. The creature in accordance with claim 16 wherein said expansible member is a tension spring secured at one end to the lower end of said lever arm and at its other end to the lower end of said actuator means, the point of connection to said actuator means being below the point of connection to said lever arm.

18. A simulated creature having snapping jaws comprising:

A. a first body member providing an elongated lower body portion, a lower head and jaw portion and an intermediate neck portion of a creature, said first body member defining an upwardly opening cavity therewithin;

B. a second body member providing an elongated upper body portion and neck portion of a creature and defining a downwardly opening cavity therewithin, said second body member having an aperture in its upper surface communicating with said cavity, said first and second body members abutting and being engaged along transversely extending surfaces to provide a body assembly;

C. a multiplicity of legs along each side of said body assembly;

D. an upper jaw member on said lower jaw and having a lever arm extending rearwardly into the cavity defined between said body members;

E. pivot means pivotably mounting said lever arm to said body assembly for pivotal motion of said upper jaw member relative to said lower jaw, said lever arm having an elongated slot through which said pivot means extends to permit movement of said upper jaw member longitudinally of said body assembly as well as pivotal movement about said pivot means;

F. actuator means for effecting pivotal movement of said upper jaw member upon movement thereof including a manually depressible button portion extending outwardly of said body assembly through said aperture and a cam portion engageable with said lever arm, said actuator means being pivotably mounted in said body assembly for movement between an at rest position wherein said button portion projects outwardly of said body assembly and a pivoted position wherein the cam portion is pivoted downwardly, said cam portion pivoting upon depression of said button portion to cam said lever arm and to effect pivotal movement of said upper jaw member from an at rest position abutting said lower jaw to an open position wherein the outer end of said upper jaw member is spaced from said lower jaw; and G. biasing means biasing said upper jaw member into the at rest position adjacent said lower jaw and said actuator means and thereby said button portion into an elevated at rest position, said pivot means, biasing means and cam portion cooperating to permit said lever arm to snap back to its at rest position after its movement to the open position and said actuator means to pivot back to its at rest position, said actuator means being pivotably mounted adjacent its upper rearward end, said cam portion is at its forward end, and said button portion is intermediate said pivotal mounting and said cam portion, said biasing means being a resiliently expansible member connected between said actuator means and said lever arm.

19. The creature in accordance with claim 18 wherein said lever arm has a cam surface along its rearward end along which said cam portion of said actuator means slides to produce longitudinal movement of said lever arm during return of said actuator means to the at rest position.

20. The creature in accordance with claim 18 wherein said pivot means is a pivot pin seated in said neck portion of said second body member, said neck portion of said second body member having apertures therein seating said pin, and wherein there is included a collar extending about said neck portions of both of said members.

* * * * *